428-408 SR
1/24/84 XR 4,427,742

United States Patent [19]
Willgoose et al.

[11] 4,427,742
[45] Jan. 24, 1984

[54] CORE OR CORE PART FOR USE IN THE LOST WAX CASTING PROCESS

[75] Inventors: Kenneth Willgoose, Shelton Lock; Rondald Brien, Allestree; Peter E. Rose, Burton-on-Trent; Clifford G. Hannah, Littleover, all of England

[73] Assignee: Rolls-Royce Limited, London, England

[21] Appl. No.: 316,431

[22] Filed: Oct. 29, 1981

[30] Foreign Application Priority Data

Nov. 12, 1981 [GB] United Kingdom ..... 8136378

[51] Int. Cl.[3] ..... B32B 9/00
[52] U.S. Cl. ..... 428/338; 428/408; 428/303; 428/432; 204/8; 204/281
[58] Field of Search ..... 428/408, 332, 433, 338, 428/432, 303; 204/8, 281, 4

[56] References Cited

U.S. PATENT DOCUMENTS

| | | | |
|---|---|---|---|
| 3,869,335 | 3/1975 | Siefert | 428/432 X |
| 4,055,213 | 10/1977 | Maher | 204/4 X |
| 4,259,278 | 3/1981 | Flegel et al. | 428/408 X |
| 4,263,367 | 4/1981 | Prewo | 428/408 X |

FOREIGN PATENT DOCUMENTS

| | | | |
|---|---|---|---|
| 54-100480 | 8/1979 | Japan | 428/408 |

*Primary Examiner*—P. Ives
*Attorney, Agent, or Firm*—Cushman, Darby & Cushman

[57] ABSTRACT

A core or core part for use in the lost wax casting process is strengthened by admixture to its material of a proportion of short reinforcing fibres.

7 Claims, 3 Drawing Figures

CORE OR CORE PART FOR USE IN THE LOST WAX CASTING PROCESS

This invention relates to a core or core part for use in the lost wax casting process.

Throughout this specification a core part is to be taken to include within its scope disposable pieces which are used to define cavities within the casting core as well as separate pieces of the core.

BACKGROUND OF THE INVENTION

In the lost wax casting process, where it is necessary to produce cavities in the finally cast object, it is common practice to use a ceramic core round which metal is cast, and which is subsequently leached or otherwise removed from within the solidified metal to leave the cavity having the same shape as the core. These cores are usually made of ceramic materials which withstand the high temperatures involved but which may be removed from the final casting without damaging the metal. These cores are commonly manufactured by an injection moulding technique in which shaped dies are used to define the form of the core.

A more recent development involves the use of disposable pieces in the manufacture of cores which have internal cavities within themselves. In this technique, sometimes known as the cored-core technique, the disposable piece is first made by an injection moulding technique and is placed in the die cavity when the core itself is injection moulded. The disposable piece is subsequently removed from the completed core so that it leaves the cavity therein which will be filled with metal when the core is used in the lost wax casting technique.

Problems arise because of the low strength of the materials used in these techniques. Thus the disposable piece or disposable core part must be strong enough to withstand the hydraulic pressures which act upon it during the injection moulding cycle for the core proper. Similarly, the ceramic core itself must be strong enough to withstand damage not only during the pouring of the metal plus the casing process (i.e. high temperatures for long periods) prior to this stage.

DESCRIPTION OF THE INVENTION

The present invention provides a core or core part as defined above in which the strength is improved without deleteriously affecting the other properties of the core or core part.

According to the present invention a core or core part for use in the lost wax casting process is made of a material having an admixture of short reinforcing fibres.

The fibres may be of chopped carbon fibre.

In one embodiment of the invention the core comprises a majority of ceramic material.

In another aspect of the invention the core part comprises a disposable material which may readily be removed, when required, by dissolving in water or other simple solvents, by burning out or by hot melting.

In all instances it is preferred to make the fibres of very short length such that they pose no problem when they are removed from the remainder of the core or from the finally cast object.

BRIEF DESCRIPTION OF THE DRAWINGS

The invention will now be particularly described merely by way of example with reference to the accompanying drawings in which.

DETAILED DESCRIPTION OF THE DRAWINGS

Figure 1:
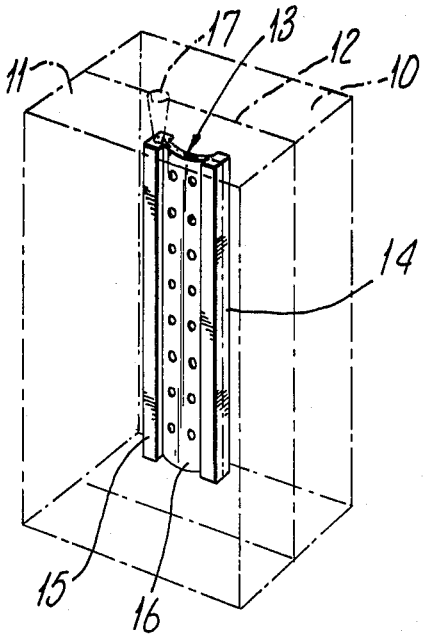
FIG. 1 is a perspective view showing the manufacture of a core part in accordance with the invention.

In FIG. 1 there is shown an injection moulding die consisting of two die halves 10 and 11 meeting at a split line 12 which is cut away to form a cavity generally indicated at 13. It will be seen that the shape of the cavity defines a shape having two longitudinally extending rails 14 and 15 and an apertured connecting membrane 16. An injection passage 17 is provided through which a fluid material may be injected to fill the cavity 13.

In use the two die halves 10 and 11 were secured together by means not shown and a disposable material was injected through the passage 17 to fill the cavity 13. A conventional injection moulding machine (not shown) was used to force the material into the cavity.

In accordance with the present invention the material injected into the cavity comprised in addition to the normal constituents of such material a proportion of chopped fibres, which in the present case were of carbon. Thus in one example of the invention the injected material consisted of an organic water soluble material with which was intimately mixed 10–15% of chopped carbon fibre. The carbon fibre consisted of fibres of 7 to 10 microns diameter and of 0.010" length.

The injected material was then allowed to solidify and the die halves 10 and 11 were separated to release the disposable core piece 18 whose external shape then conformed with the internal shape of the cavity 13.

Figure 2:
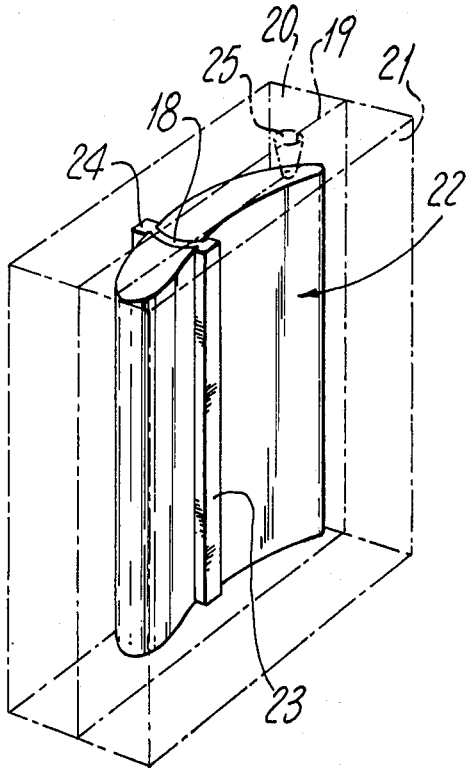
FIG. 2 is a view similar to FIG. 1 but showing the manufacture of a core in accordance with the invention and, FIG. 3 shows how the core of FIG. 2 is used in the lost wax casting process.
Figure 3:
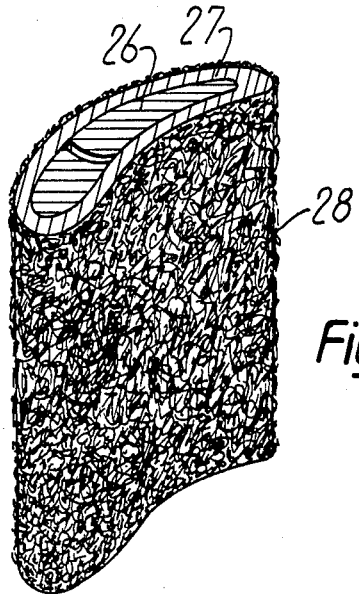

The disposable piece 18 as produced was then located in a second injection moulding die (FIG. 2). This die consisted of two halves 20 and 21 divided along a split line 19 and defining in a similar manner to the die of FIG. 1 a cavity 22 whose internal shape was approximately of aerofoil section. Additionally cavity 22 is provided with longitudinally extending grooves 23 and 24 into which the rails 14 and 15 extend to retain the piece 18. Once again an entry passage 25 was provided for the injection of fluid material into the cavity 22. A fluid material was then injected to the cavity as with the FIG. 1 apparatus, however, in this instance the material injected comprised a ceramic slurry with a 10–15% of admixture of carbon fibre exactly similar to that used to form the piece 18.

When the ceramic had solidified the core 26 was formed which initially had embodied therein the disposable piece 18. The disposable piece 18 consisting of organic material was leached out by immersion in hot water. By heating the core 26 to a high temperature the ceramic material of the core was strengthened. The carbon fibres which formed part of the piece 18 were of sufficiently small size that they ran out of the apertures within the core along with the remaining material of the piece 18.

The core 26 thus formed was then waxed in the normal waxing process so that it was left with a layer of wax 27 whose shape defined the shape of the final cast object. The wax core was then shelled in a conventional manner to produce a shell mould 28 round the outside of the wax. The wax was then melted out and the core and shell fired preparatory to metal being poured into the mould. The core 26 defined a cavity within the finally produced casting while the cavity within the core left by disposable core part 18 became filled with metal to form an internal feature within this cavity.

It will be seen that the carbon fibre addition made in accordance with the present invention strengthens the piece 18 and the core 26. Therefore the piece 18 is better able to withstand the hydraulic forces which it inevitably experiences while the ceramic material of the core 26 is being injected. Similarly, the carbon fibre added to the material of the core 26 improves the low temperature strength of this object. It will be understood that although such ceramic cores are relatively strong at high temperatures, low temperature strength is poor so that they are easily broken by handling. The added carbon fibre improves this low temperature strength. Clearly the carbon fibre cannot withstand the very high temperatures used in firing the core but under these conditions the ceramic is in any case strong enough by itself.

In one particular example of a core part made in accordance with the invention it was found that the strength of the part was increased so that the part was able to withstand a ceramic injection step whereas using the material without the carbon fibre addition almost all the core parts were broken when the ceramic was injected.

It should be understood that although described above when used with specific core part and core materials it is to be expected that the fibre reinforcement will improve the strength of a wide variety of such material. It is of course necessary that the material used does not react with the fibre and that the injection moulding can take place at a temperature which does not destroy the fibre. It will be appreciated that a number of fibrous reinforcement could be used in the technique of the invention; in particular we would mention glass fibre or Kevlar fibre.

We claim:

1. A core or core part shaped to define a cavity in a subsequent core or cast article adapted for use in the lost wax casting process, said core or core part comprising an admixture of distributed short reinforcing fibers dispersed but devoid of deliberate orientation in a ceramic or disposable material, the core or core part including the short reinforcing fibers distributed therein adapted for removal from the core or article into which it is at least partially embedded to define the cavity.

2. A core or core part shaped to define a cavity in a subsequent core or cast article and adapted for use in the lost wax casting process, said core or core part consisting essentially of a ceramic or disposable material having therein short length non-reactive fibers dispersed throughout the ceramic or disposable material and adapted for removal from the remainder of the core or from the finally cast object while enhancing the core's handling strength at low temperature.

3. A core or core part as claimed in claim 1 or 2 in which chopped carbon fibers are the reinforcing fibers.

4. A core part adapted to be placed at least partially within the core of claim 2 for use in the lost wax casing process, said core part consisting essentially of a disposable material that is removable from the ceramic material without damage to the core in which it is at least partially contained, and having short carbon reinforcing fibres distributed throughout the disposable material, the fibre-reinforced core part exhibiting improved resistance to hydraulic force.

5. The core or core part as claimed in claim 4 wherein the short carbon fibres are readily removed from the remainder of the core or from the finally cast object.

6. A core or core part as claimed in claim 3 and in which the carbon fibre comprises about 10–15% of the material of which the core or core part is made.

7. A core or core part as claimed in claim 3 and in which said carbon fibre comprises fibres of about 7–10 microns diameter and of about 0.010" in length.

* * * * *

UNITED STATES PATENT AND TRADEMARK OFFICE

CERTIFICATE OF CORRECTION

PATENT NO. : 4,427,742

DATED : Jan. 24, 1984

INVENTOR(S) : Willgoose, et al.

It is certified that error appears in the above-identified patent and that said Letters Patent is hereby corrected as shown below:

Please correct the Front Page Format as follows:

DELETE

[30] Foreign Application Priority Data
Nov. 12, 1981 [GB] United Kingdom ..... 8136378 and

INSERT THEREFOR

[30] Foreign Application Priority Data
Nov. 12, 1980 [GB] United Kingdom ..... 8036378

Signed and Sealed this

Tenth Day of April 1984

[SEAL]

Attest:

GERALD J. MOSSINGHOFF

Attesting Officer

Commissioner of Patents and Trademarks